US005615755A

United States Patent [19]

Karlsson

[11] Patent Number: 5,615,755

[45] Date of Patent: Apr. 1, 1997

[54] END PIECE SEAL FOR A RAIL VEHICLE SLACK ADJUSTER

[75] Inventor: Uno Karlsson, Malmo, Sweden

[73] Assignee: SAB WABCO AB, Sweden

[21] Appl. No.: 507,306

[22] PCT Filed: Mar. 1, 1994

[86] PCT No.: PCT/SE94/00166

§ 371 Date: Oct. 11, 1995

§ 102(e) Date: Oct. 11, 1995

[87] PCT Pub. No.: WO94/20348

PCT Pub. Date: Sep. 15, 1994

[30] Foreign Application Priority Data

Mar. 1, 1993 [SE] Sweden ..... 9300668

[51] Int. Cl.[6] ..... F16J 15/16; B61H 15/00; F16F 9/38

[52] U.S. Cl. ..... 188/322.12; 188/198; 277/24; 277/214; 277/215

[58] Field of Search ..... 188/198, 271, 188/322.12; 277/24, 29, 134, 152, 214, 215, 102

[56] References Cited

U.S. PATENT DOCUMENTS

| | | | |
|---|---|---|---|
| 2,196,337 | 4/1940 | Loweke | 277/215 X |
| 4,344,631 | 8/1982 | Winn | 277/29 |
| 4,482,160 | 11/1984 | Yanagi et al. | 277/29 X |
| 5,025,900 | 6/1991 | Severinsson | 188/198 X |
| 5,476,269 | 12/1995 | Karlsson | 188/198 X |

*Primary Examiner*—Peter M. Poon
*Attorney, Agent, or Firm*—Laurence R. Brown

[57] ABSTRACT

An end piece or barrel head (1) for a rail vehicle axial slack adjuster is at its outer periphery connected to a barrel (2) of the adjuster and is arranged around a rotatably and axially movable tube (3). The end piece is provided with an internal, circumferential groove (4), connected to the exterior by way of a number of channels (5) opening in the end wall (1') of the end piece for allowing water collected in the groove to freely pass out to the exterior. The end piece is extended further into the barrel by way of a sleeve (1"), which is connected to the groove by way of notches (6) and contains a sealing ring (7) engaging the tube and sealingly cooperating with the sleeve.

1 Claim, 1 Drawing Sheet

END PIECE SEAL FOR A RAIL VEHICLE SLACK ADJUSTER

TECHNICAL FIELD

This invention relates to an end piece for a rail vehicle axial slack adjuster, which end piece is connected to a barrel of the adjuster at its outer periphery, is sealingly arranged around a tube, which is rotatable and axially moveable relative thereto, and around the tube is provided with an internal, circumferential groove, which is connected to the exterior by means of a number of channels opening in the end wall of the end piece.

BACKGROUND OF THE INVENTION

Rail vehicle alack adjusters work in an extremely harsh environment underneath the vehicles, which means that the sealing arrangements have to be effective so as to protect all interior details against moisture, water, snow, dust and so forth. The problem is enhanced by the extremely long intervals between interior services of the slack adjusters.

At end pieces or barrel heads for slack adjusters it has earlier been customary to provide as tight sealings as possible between the tube and the end piece, for example by means of two effective sealing rings in the end piece. However, due to the mutual movements between the parts, a certain under-pressure could be created inside the slack adjuster sucking moist, water and dust into the adjuster without any possibility to get out again. It goes without saying that such contaminants inside the adjuster can cause harm.

A recently designed end piece of the kind defined above, which is disclosed in Swedish Patent Application No. 9200180-9, is based on the different philosophy that the creation of an under-pressure inside the adjuster shall be obviated and that any contaminants entering the end piece around the tube shall be given the opportunity to leave without getting into the adjuster itself.

THE INVENTION

The results obtained by the design defined above are satisfactory. However, even improved results may according to the invention be obtained in that the end piece is provided with a sleeve, which extends further into the barrel, is connected to the groove by means of notches and contains a sealing ring engaging the tube and sealingly cooperating with the sleeve.

This sealing ring is so positioned within the sleeve that it will not be displaced on the tube at normal relative axial and rotating movements between the barrel and the tube.

BRIEF DESCRIPTION OF THE DRAWING

The invention will be described in further detail below reference being made to the accompanying drawing, in which.

DETAILED DESCRIPTION OF A PREFERRED EMBODIMENT

Figure 1:
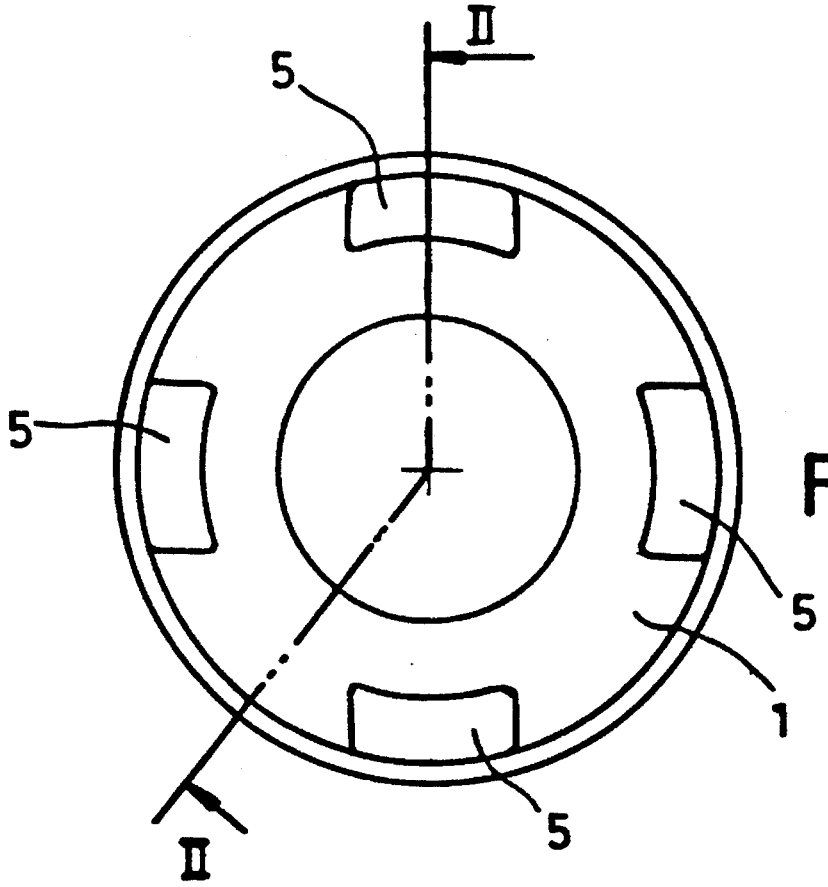
FIG. 1 is and end-view of an end piece according to the invention and FIG. 2 is a side-view, partly in section, of an axial slack adjuster provided with such an end piece, shown in a section along the line II—II in FIG. 1.
Figure 2:
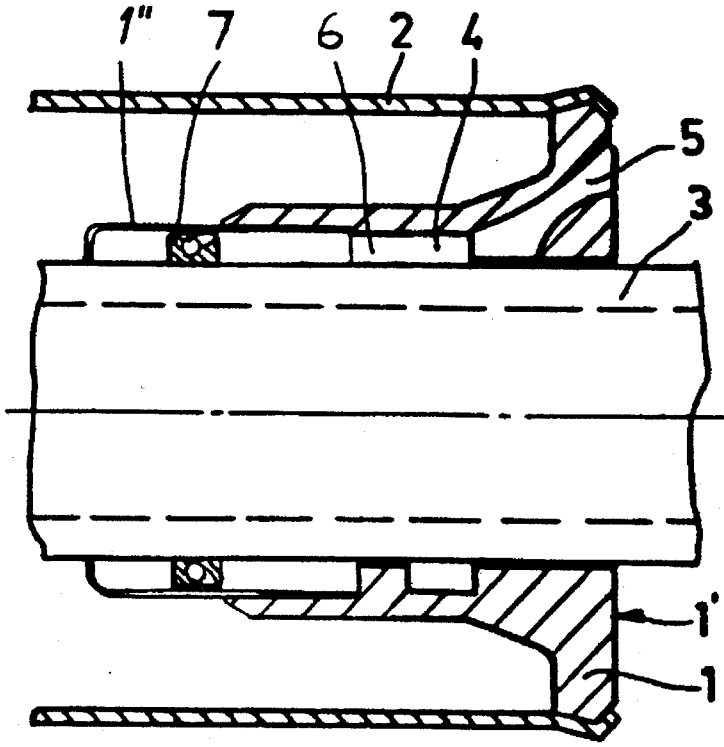

A cylindrical end piece or barrel head 1 is attached to a tubular barrel 2 of a conventional axial slack adjuster for a railway vehicle. It is to cooperate with a rotatably and axially movable tube 3 and accordingly has an inner diameter corresponding to the outer diameter of this tube 3.

At a certain distance from its end wall 1' the end piece 1 is provided with a circumferential groove 4 around the tube 3 for collecting any contaminants (like water) which have entered from the exterior along the tube 3.

For allowing these contaminants to freely leave the groove 4 there are a number of channels 5 connecting the groove 4 with the end wall 1'. In the shown case there are four channels 5, so that contaminants collected in the groove 4 can freely leave through a channel 5 irrespective of the angular position of the end piece 1. The inclination of the channels 5 is chosen so that a free flow is guaranteed.

To the end piece 1 is fastened a sleeve 1", which extends further into the barrel 2 and has an end flange surrounding the tube 3. The sleeve 1" maybe manufactured of stainless material.

The groove 4 and the sleeve 1" are connected by means of axial notches 6, preferably in line with the channels 5.

Inside the sleeve 1" a sealing ring 7 is elastically clamped on the tube 3 and cooperates sealingly with the sleeve.

The position of the sealing ring 7 within the sleeve 1" is such that at normal axial and rotational relative movements of the tube 3 and the barrel 2 with its end piece 1, the sealing ring 7 does not move on the tube 3, but only at such extreme movements that occur at the replacement of worn out brake shoes and the like.

I claim:

1. In an annular sealing end piece connected to a slack adjuster barrel for joint axial and rotatable movement on a slack adjuster tube, said end piece positioned between said barrel and said tube and functioning to prevent external contaminants from entering the slack adjuster barrel, said end piece providing a number of channels extending through an end piece wall and connected with an internal groove circumferentially positioned about said slack adjuster tube, the improvement comprising in combination:

a sleeve coupled by axial notches to said end piece to extend inwardly into said barrel from said groove, and a circumferential sealing ring sealingly disposed between the sleeve and the slack adjuster tube.

* * * * *